US012503841B2

(12) United States Patent
Nagata

(10) Patent No.: US 12,503,841 B2
(45) Date of Patent: Dec. 23, 2025

(54) URINE SCATTERING PREVENTION DEVICE

(71) Applicant: SHIN NIPPON BIOMEDICAL LABORATORIES, LTD., Kagoshima (JP)

(72) Inventor: Ryoichi Nagata, Kagoshima (JP)

(73) Assignee: SHIN NIPPON BIOMEDICAL LABORATORIES, LTD., Kagoshima (JP)

( * ) Notice: Subject to any disclaimer, the term of this patent is extended or adjusted under 35 U.S.C. 154(b) by 0 days.

(21) Appl. No.: 17/794,249

(22) PCT Filed: Jan. 25, 2021

(86) PCT No.: PCT/JP2021/002498

§ 371 (c)(1),
(2) Date: Jul. 20, 2022

(87) PCT Pub. No.: WO2021/153519

PCT Pub. Date: Aug. 5, 2021

(65) Prior Publication Data

US 2023/0046122 A1 Feb. 16, 2023

(30) Foreign Application Priority Data

Jan. 27, 2020 (JP) ..... 2020-011014

(51) Int. Cl.
*E03D 13/00* (2006.01)

(52) U.S. Cl.
CPC ..... *E03D 13/005* (2013.01)

(58) Field of Classification Search
CPC ..... E03D 13/005; E03D 13/00; A61B 5/207; A61B 5/208; Y10S 4/902; A47K 13/06; A61F 5/445
See application file for complete search history.

(56) References Cited

U.S. PATENT DOCUMENTS

| | | | | |
|---|---|---|---|---|
| 4,982,455 A * | 1/1991 | Carter | E03D 13/00 4/307 |
| 5,299,328 A * | 4/1994 | Walega | E03D 1/003 4/341 |
| 6,055,681 A * | 5/2000 | Lyons | E03D 9/00 4/300.3 |
| 10,066,381 B2 * | 9/2018 | Delaney | E03D 13/005 |

FOREIGN PATENT DOCUMENTS

| | | |
|---|---|---|
| CN | 206616655 U * | 11/2017 |
| JP | 2008-5719 A1 | 3/2008 |
| JP | 3200310 U | 10/2015 |
| JP | 2017-04401 A1 | 3/2017 |

OTHER PUBLICATIONS

CN206616655 translation retrieved on Jan. 12, 2024 (Year: 2017).*

* cited by examiner

*Primary Examiner* — Janie M Loeppke
(74) *Attorney, Agent, or Firm* — Liang Legal Group, PLLC

(57) ABSTRACT

[Problem] To provide a urine scattering prevention device which does not give off a foul smell even when used, and which is easy to replace. [Solution] A urine scattering prevention device 1 includes a urine receiving portion 5 disposed in a urinal 3, and a leg portion 7 which supports the urine receiving portion 5 vertically upward.

5 Claims, 3 Drawing Sheets

URINE SCATTERING PREVENTION DEVICE

BACKGROUND

Technical Field

The present invention relates to a urine scattering prevention device used for a male urinal.

Background Art

In Japanese Registered Utility Model No. 3200310, a urine scattering prevention device for a male urinal is disclosed.

In JP-A-2017-044014, a scattering prevention tool for a men's urinal is disclosed.

Patent Document 1: Japanese Registered Utility Model No. 3200310

SUMMARY OF THE INVENTION

Problems to Be Solved By the Invention

The urine scattering prevention device disclosed in Japanese Registered Utility Model No. 3200310 has a scattering prevention plate protruding significantly from a urinal. Therefore, there is a problem that a bad odor wafts from urine adhering to the scattering prevention plate when the device is used for a long time.

The scattering prevention tool disclosed in JP-A-2017-044014 can be installed inside a urinal. However, there is a problem that it is complicated to replace the scattering prevention tool.

An object of the present invention is to provide a urine scattering prevention device that does not cause a bad odor to waft even when used and is easy to replace.

Solutions to the Problems

Basically, the present invention is based on a knowledge that, since a urine scattering prevention device is configured to have a urine receiving portion installed inside a urinal and a leg portion that supports the urine receiving portion, the urine scattering prevention device that does not cause a bad odor to waft even when used and is easy to replace can be provided.

A first aspect of the present invention relates to a urine scattering prevention device 1. The device includes: a urine receiving portion 5 installed inside a male urinal 3; and a leg portion 7 that supports the urine receiving portion 5 vertically upward.

Since the urine receiving portion 5 that receives urine is installed inside the urinal 3, a bad odor does not waft even when the device 1 is used. Since the device 1 has the leg portion 7 that supports the urine receiving portion 5, the urine receiving portion inside the urinal need not directly be removed and the device can be easily replaced.

In a preferred example of the device 1, the urine receiving portion 5 includes a urine receiving area 9 to which urine is expected to be applied, and at least the urine receiving area 9 is formed of cloth or in a mesh shape. Since the urine receiving area 9 is cloth or in a mesh shape, scattering of urine can be effectively avoided.

In a preferred example of the device 1, at least a part of the urine receiving portion 5 is in contact with an inner wall of the urinal 3. Since the urine receiving portion 5 is in contact with the inner wall of the urinal 3, urine accumulating in the urine receiving portion can be washed.

In a preferred example of the device 1, the leg portion 7 has two or more pieces of constituent legs 7*a*,7*b*,7*c*. Since a plurality of pieces of constituent legs are included, the device 1 can be replaced more easily. In this case, similarly to a tripod, the leg portion 7 can preferably be opened and closed. In that case, when the device 1 is recovered, a plurality of leg portions can be closed and made compact. When the device 1 is installed, the device 1 can be stably installed by opening the leg portions.

In a preferred example of the device 1, a lower end portion of the leg portion 7 is installed on a lower portion inside a urinal or on a ground near the urinal. When the lower end portion of the leg portion 7 is installed on the lower portion inside the urinal, the urinal is outwardly clean. When the lower end portion of the leg portion 7 is installed on the ground near the urinal, urine does not attach to the lower end portion of the leg portion, and thus, the device 1 can be easily exchanged.

Advantageous Effects of the Invention

The urine scattering prevention device of the present invention has the urine receiving portion installed inside the urinal and the leg portion that supports the urine receiving portion. Since the urine receiving portion that receives urine is installed inside the urinal, a bad odor does not waft even when the device is used. Since the device has the leg portion that supports the urine receiving portion, the urine receiving portion inside the urinal need not directly be removed and the device can be easily replaced.

BRIEF DESCRIPTION OF THE DRAWINGS

FIG. 2 is conceptual diagrams for describing a urine receiving portion.

DETAILED DESCRIPTION OF THE INVENTION

Figure 1:
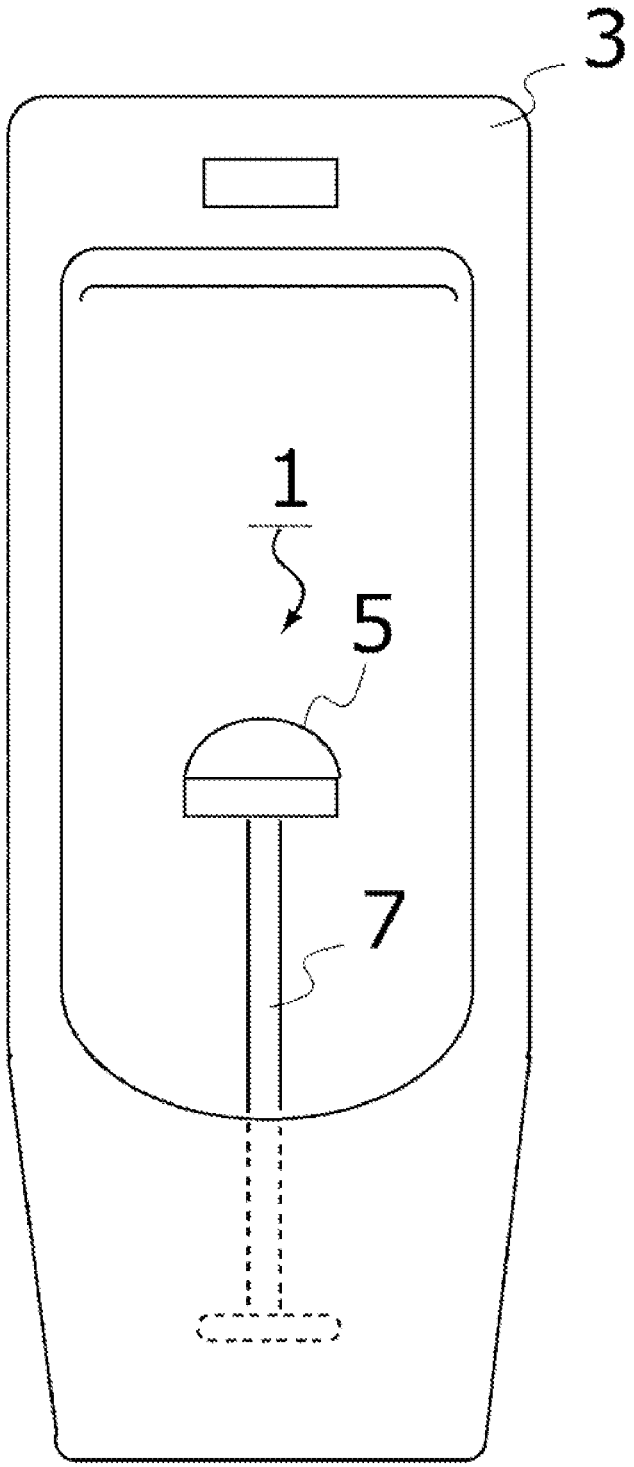
FIG. 1 is a conceptual diagram for describing a urine scattering prevention device of the present invention.

The following describes embodiments of the present invention using the drawings. FIG. 1 is a conceptual diagram for describing a urine scattering prevention device of the present invention.

As illustrated in FIG. 1, a urine scattering prevention device 1 includes a urine receiving portion 5 installed inside a male urinal 3 and a leg portion 7 that supports the urine receiving portion 5 vertically upward. The urine scattering prevention device 1 is a device that is usually installed in a urinal (a toilet bowl for discharging and processing urine) for males and used for avoiding a situation of scattering of urine.

FIG. 2 is conceptual diagrams for describing a urine receiving portion. The urine receiving portion 5 is a portion (a part) where urine is assumed to be received. Since the urine receiving portion 5 is installed inside the urinal 3, a bad odor does not waft even when the device 1 is used.

Figure 2A:
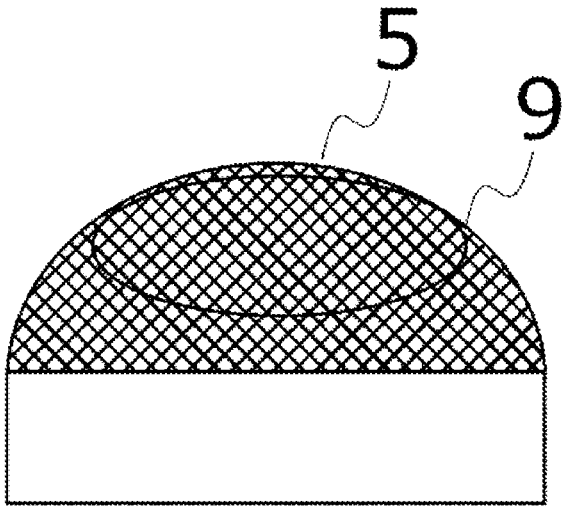
FIG. 2(A) is a conceptual diagram illustrating an example of a urine receiving portion having an upward convex shape.
Figure 2B:
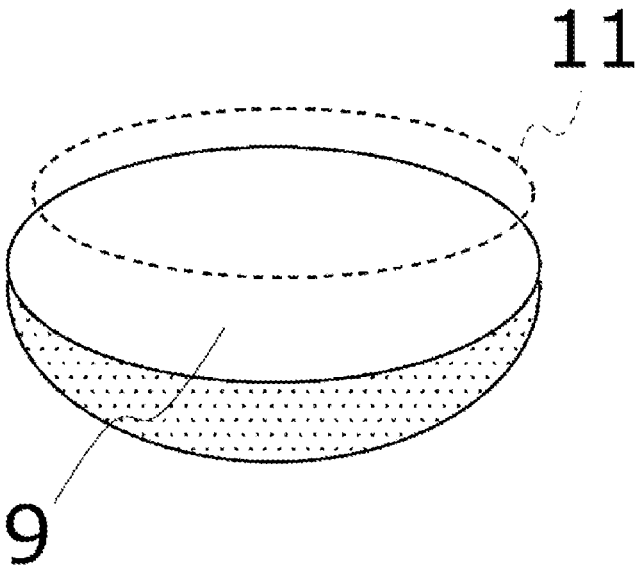
FIG. 2(B) is a conceptual diagram illustrating an example of a urine receiving portion having a downward convex shape.

FIG. 2(A) is a conceptual diagram illustrating an example of a urine receiving portion having an upward convex shape. FIG. 2(B) is a conceptual diagram illustrating an example of a urine receiving portion having a downward convex shape. In FIG. 2(A), a portion including a urine receiving area 9 is configured to be in a mesh shape. The urine receiving area 9 is an area in the urine receiving portion 5 to which urine is expected to be applied. Since the urine receiving area 9 is cloth or in a mesh shape, scattering of urine can be effectively avoided. It is only necessary to appropriately adjust a size of the urine receiving portion 5 to a size of the urinal. An example of the size in a lateral direction of the urine receiving portion 5 is 1 cm or more and 30 cm or less, may be 3 cm or more and 20 cm or less, or may be 4 cm or more and 15 cm or less. The urine receiving area 9 may be formed of cloth.

As illustrated in FIG. 2(B), the urine receiving portion 5 preferably has a contact region 11 that is in contact with an inner wall of the urinal 3. By having the contact region 11, the urine receiving portion 5 is in contact with the inner wall of the urinal 3. Accordingly, when the urinal 3 flows water for cleaning, the water can be guided to the urine receiving portion 5, thereby allowing washing the urine receiving portion 5. Therefore, the contact region 11 is preferably a portion having a shape identical to a shape of the inner wall of the urinal 3. A length in a lateral direction of the contact region 11 is preferably ½ or more and ⅔ or less of the size in the lateral direction of the urine receiving portion 5, may be 1/10 or more and ½ or less, may be ⅕ or more and ½ or less, or may be ⅕ or more and ⅓ or less. The larger an area where the urine receiving portion 5 is in contact with the inner wall of the urinal 3 is, the more effectively water can be guided to the urine receiving portion 5. The contact region 11 preferably lies in a position higher in a vertical direction than the urine receiving area 9. Since the contact region 11 is positioned at the position higher than the urine receiving area 9, water can be effectively guided to the urine receiving portion 5. An average height of the contact region 11 is preferably 5 mm or more and 20 cm or less higher than an average height of the urine receiving area 9, may be 5 mm or more and 10 cm or less higher, or may be 1 cm or more and 5 cm or less higher.

As illustrated in FIG. 1, the urine scattering prevention device 1 includes the leg portion 7 that supports the urine receiving portion 5 vertically upward. If the leg portion 7 does not exist, a urine scattering prevention device to which urine is attached needs to be directly removed. Additionally, when a new device is installed, the device needs to be directly installed in a lower portion area inside a urinal. On the other hand, when the device 1 of the present invention is exchanged, it is only necessary to grip the leg portion 7 to remove the device from the inside of the urinal and grip the leg portion 7 of a new device 1 to install the new device 1 inside the urinal 3. Since the urine scattering prevention device 1 of the present invention has the leg portion 7 that supports the urine receiving portion 5, the urine receiving portion inside the urinal need not directly be removed and the device 1 can be easily replaced.

In a preferred example of the device 1, the leg portion 7 has two or more pieces of constituent legs 7*a*, 7*b*, 7*c*. Since a plurality of pieces of constituent legs are included, the device 1 can be replaced more easily. In this case, similarly to a tripod, the leg portion 7 can preferably be opened and closed. In that case, when the device 1 is recovered, a plurality of leg portions can be closed and made compact. When the device 1 is installed, the device 1 can be stably installed by opening the leg portions.

In a preferred example of the device 1, a lower end portion of the leg portion 7 is installed on a lower portion inside the urinal or on a ground near the urinal. When the lower end portion of the leg portion 7 is installed on the lower portion inside the urinal, the urinal is outwardly clean. When the lower end portion of the leg portion 7 is installed on the ground near the urinal, urine does not attach to the lower end portion of the leg portion, and thus, the device 1 can be easily exchanged. All of the leg portions may be installed on the lower portion inside the urinal or on the ground near the urinal, or any of them may be installed on the lower portion inside the urinal and the rest may be installed on the ground near the urinal.

Figure 3:
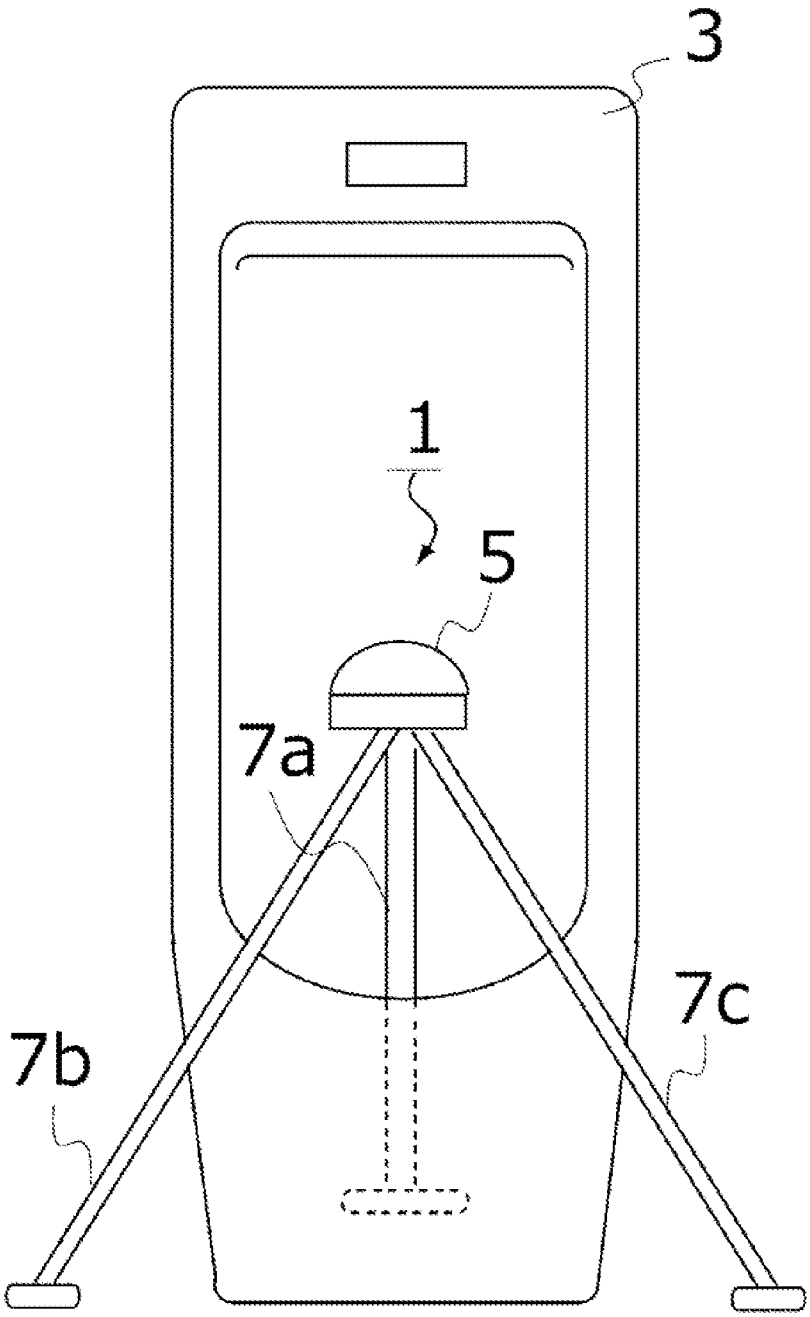
FIG. 3 is a conceptual diagram for describing a urine scattering prevention device of the present invention.

FIG. 3 is a conceptual diagram for describing a urine scattering prevention device of the present invention. In this example, a first leg portion 7*a* is installed on the lower portion inside the urinal. Meanwhile, a second leg portion 7*b* and a third leg portion 7*c* are installed on the ground near the urinal. Each leg portion is preferably allowed to adjust a length. It is only necessary for each leg portion to be configured of portions having two diameters and to be structured such that a portion having a smaller diameter is inserted inside a portion having a larger diameter and each leg portion can be secured to a given position. Having such a structure can adjust the length of each leg portion. In this example, in a state before use, the leg portions are in a state of being folded. When the device 1 is installed, the first leg portion 7*a* is opened and the length of the first leg portion 7*a* is adjusted, and then, a lower end of the first leg portion 7*a* is installed on the lower portion inside the urinal. Then, after the second leg portion 7*b* and the third leg portion 7*c* are opened, the lengths of the second leg portion 7*b* and the third leg portion 7*c* are adjusted, and the second leg portion 7*b* and the third leg portion 7*c* are installed on the ground near the urinal. Accordingly, the urine scattering prevention device 1 can be easily installed inside the urinal.

INDUSTRIAL APPLICABILITY

The present invention can be used in the cleaning business and the sanitation industry.

What is claimed is:

1. A urine scattering prevention device (1) comprising:

a urinal (3);

a urine receiving portion (5), which is a separate part installed inside the urinal (3); and a leg portion (7) that supports the urine receiving portion (5) vertically upward, wherein the leg portion (7) has a first constituent leg (7*a*), a second constituent leg (7*b*), and a third constituent leg (7*c*), wherein the first constituent leg (7*a*) is a straight member, an upper end of which is attached to an underside of the urine receiving portion (5), and a lower end portion of the first constituent leg (7*a*) is installed on a lower portion inside the urinal (3) and lower end portions of the second and the third constituent legs (7*b*, 7*c*) are installed on a ground near the urinal (3).

2. The urine scattering prevention device (1) according to claim 1, wherein the urine receiving portion (5) includes a urine receiving area (9) to which urine is expected to be applied, and the urine receiving area (9) is formed of cloth or in a mesh shape.

3. The urine scattering prevention device (1) according to claim 1, wherein at least a part of the urine receiving portion (5) is in contact with an inner wall of the urinal (3).

4. The urine scattering prevention device (1) according to claim 1, wherein the first, the second and the third constituent legs (7*a*, 7*b*, 7*c*) are capable of being folded or opened.

5. The urine scattering prevention device (1) according to claim 1, wherein lengths of the first, the second and the third constituent legs (7*a*, 7*b*, 7*c*) are adjustable.

* * * * *